US012036466B2

(12) United States Patent
Attew et al.

(10) Patent No.: US 12,036,466 B2
(45) Date of Patent: Jul. 16, 2024

(54) PROTECTING THE EDGES OF SPORTS BOARDS

(71) Applicant: Snowtech Products Ltd, London (GB)

(72) Inventors: Dean Attew, London (GB); James Hoffman, London (GB)

(73) Assignee: SNOWTECH PRODUCTS LTD, London (GB)

( * ) Notice: Subject to any disclaimer, the term of this patent is extended or adjusted under 35 U.S.C. 154(b) by 738 days.

(21) Appl. No.: 17/096,386

(22) Filed: Nov. 12, 2020

(65) Prior Publication Data

US 2022/0105420 A1 Apr. 7, 2022

(30) Foreign Application Priority Data

Oct. 2, 2020 (GB) ..... 2015651

(51) Int. Cl.
*A63C 11/02* (2006.01)
*A63C 5/06* (2006.01)

(52) U.S. Cl.
CPC ..... *A63C 5/06* (2013.01); *A63C 11/027* (2013.01)

(58) Field of Classification Search
CPC .... B65D 81/054; B65D 81/053; B65D 71/04; A63C 5/00; A63C 5/0485; A63C 11/027; A63C 11/02; A63C 5/062; A63C 5/048
USPC ..... 206/453, 454, 315.1, 586, 523; 150/162, 150/154; 229/87.02; 269/906, 905; 224/917
See application file for complete search history.

(56) References Cited

U.S. PATENT DOCUMENTS 2,166,798 A * 7/1939 Cote ..... B29C 70/76 174/136
4,153,230 A * 5/1979 Giacin ..... A47B 95/043 5/663
4,582,739 A * 4/1986 Givens ..... B29C 66/474 52/782.2
5,639,072 A * 6/1997 McCall ..... A47B 95/043 248/345.1
6,378,831 B1 * 4/2002 Copeland, Jr. ..... A47B 13/083 108/27
7,182,993 B1 * 2/2007 Hamilton ..... A63H 33/006 428/122

(Continued)

FOREIGN PATENT DOCUMENTS

WO WO-2012031369 A1 * 3/2012 ..... G06F 1/1626

*Primary Examiner* — Rafael A Ortiz
(74) *Attorney, Agent, or Firm* — Westman, Champlin & Koehler, P.A.; Amanda M. Prose

(57) ABSTRACT

An edge protector for a sports board in the form of a bead of a resilient material having a cross-section comprising a central portion and, extending therefrom in one direction, a tapering impact-absorbing section and, extending from the central portion in the opposing direction, a pair of convergent leg sections for engaging an edge of the board. The central portion and the impact-absorbing section together form a triangular cross-section, which is particularly suited to receiving and dissipating an impact. The triangular section can be a hollow triangular section to reduce weight and tailor the impact response. One leg of the pair extends beyond the other leg to case fitting. The bead is preferably formed by extrusion; silicone with a Shore A hardness of between 62 and 68 provides an ideal resilient material.

14 Claims, 2 Drawing Sheets

(56) References Cited

U.S. PATENT DOCUMENTS

| | | | | |
|---|---|---|---|---|
| 7,942,269 | B2 * | 5/2011 | Lu | H01L 21/67359 206/453 |
| 8,981,195 | B2 * | 3/2015 | Johnston | G01D 13/06 84/453 |
| 11,542,970 | B2 * | 1/2023 | Chlystek | F16B 5/0635 |
| 2003/0221981 | A1 * | 12/2003 | Havlovick | A63C 11/027 206/593 |
| 2004/0221524 | A1 * | 11/2004 | Poddany | F24S 25/60 52/204.5 |
| 2006/0289301 | A1 * | 12/2006 | Ebert | C25C 7/02 204/279 |
| 2010/0147723 | A1 * | 6/2010 | Farrell | B65D 61/00 206/453 |
| 2010/0236968 | A1 * | 9/2010 | De Jesus | B65D 81/1275 53/472 |
| 2011/0048984 | A1 * | 3/2011 | Koett | B63B 32/57 206/586 |
| 2012/0048350 | A1 * | 3/2012 | Gonzalez | B65D 81/057 136/251 |
| 2013/0306515 | A1 * | 11/2013 | Murdoch | B65D 81/055 206/586 |
| 2015/0101953 | A1 * | 4/2015 | Yue | B65D 25/107 220/587 |

* cited by examiner

PROTECTING THE EDGES OF SPORTS BOARDS

CROSS-REFERENCE TO RELATED APPLICATION

This patent application claims the benefit of priority under 35 U.S.C. 119 of GB Patent Application No. 2015651.9, filed on Oct. 2, 2020, the contents of which are hereby incorporated by reference for all purposes as if fully set forth herein.

FIELD OF THE INVENTION

The present invention relates to the protection of the sidewall & edges of sports boards, especially snowboards.

BACKGROUND ART

Numerous sports employ board-shaped equipment, i.e. generally thin and rigid planar panels. Typically, the person engaging in the sport must stand or be supported on the board whilst engaged in the sport. Examples include snowboarding, skiing, surfing, skateboarding and the like.

Often, the sport must be carried out at specific locations, such as mountainous areas with significant snowfall, or coastal areas susceptible to wave activity. As a result, many of those who engage in the sport need to travel in order to reach the location in question, taking their equipment with them to and/or from the location. This raises the risk of damage during transit, especially during air travel as the board must be entrusted to airport staff for loading on and off the aircraft. The personal experience of one inventor is that impacts to a snowboard whilst in transit through airline baggage can severely damage the snowboard. In one case, the snowboard had been subjected to an impact directly to the snowboard sidewall and steel edge, which resulted in an indentation to the steel edge rim of the snowboard and a separation of the various layers which form the (laminated) snowboard.

Damage such as this may be difficult to repair and (even if possible) may still leave the user uncertain as to the integrity and usability of the board; it supports the weight of the user during energetic manoeuvres and is thus subject to mechanical stresses in use, which it must withstand. A failure could lead to injury for the user and thus it is important that the user has confidence in the mechanical integrity of the board.

It is not generally possible for an individual traveller to ensure the smooth handling in transit of their sports board. Most snowboard bags (for example) are made of a polyester/nylon material outer and have limited padding to protect against impact—typically in the form of thin foam only. Their principal function is to keep equipment together, as opposed to providing protection. Hard plastic cases are available, but are bulky and heavy 10 (thus adding to airline costs); generally airline carriers are only willing to offer damage protection to sporting goods when placed in a hardened case.

SUMMARY OF THE INVENTION

The present invention seeks to provide an easily applied (and removed) protector for sports boards which is effective in limiting the prospects for damage to the board, especially during airline transit, but also general transportation and postal/shipping of new snowboards, in most cases where a snowboard is being transported it is vulnerable to damage.

We have identified that the principal risk is to the sidewall and edge of the board, as this is the part of the board that is most likely to suffer an impact during handling.

The present invention therefore provides an edge protector for a sports board in the form of a bead of a resilient material having a cross-section comprising a central portion and, extending therefrom in one direction, a tapering impact-absorbing section and, extending from the central portion in the opposing direction, a pair of convergent leg sections for engaging an edge of the board.

The central portion and the impact-absorbing section together form a triangular cross-section, which is particularly suited to receiving and dissipating an impact. The triangular section can be a hollow triangular section to reduce weight and tailor the impact response. The central portion can form one side of the triangle and the impact-absorbing section can then be provided by the remaining two sides of the triangle. The wall thickness of the hollow triangular section is preferably between about 4 mm and about 6 mm. The exact size will determine the overall properties of the protector and can be adjusted in the light of the strength of the material which has been selected, the overall dimensions of the protector, and the level of impact that is to be protected against. In the context of a snowboard, and silicone with a Shore Hardness of 65, we find that 4 mm for the majority of the triangular section is appropriate. The wall forming the side of the triangle defined by the central portion preferably varies in thickness, being thicker at one end than the other.

Generally, it is easier to fit the protector in place if one leg of the pair extends beyond the other leg, effectively catching the base of the snowboard opening separating the two legs and thus enabling the user to follow a clear path. Regardless, the leg sections ideally have a cross-sectional thickness of between 2 mm and 4.5 mm; they can be narrower at their tip than at their base to allow that part to flex more easily. The legs essentially wrap onto the base and top layers, holding the protector in place on the snowboard.

The bead is preferably formed by extrusion, which is one way of allowing the cross-section of the bead to be substantially constant along its length. Silicone provides an ideal resilient material, and a Shore A hardness of between 62 and 68 provides a suitable combination of factors as noted below.

The sports board can be a snowboard, a ski, a surfboard, a body board or a skateboard, or any similar board.

The invention also relates to the combination of a sports board, and an edge protector as defined above, and to a sports board to the edge of which such an edge protector is fitted.

BRIEF DESCRIPTION OF THE DRAWINGS

An embodiment of the present invention will now be described by way of example, with reference to the accompanying figures.

DETAILED DESCRIPTION OF THE EMBODIMENTS

FIGS. 1 to 4 show an edge protector suitable for limiting or reducing the damage to a snowboard whilst in transit. With appropriate adjustments to its dimensions, the same design can be employed as an edge protector for other types of sports boards such as a ski, a surfboard, a body board or a skateboard. The principal aim is to enable the board to withstand a severe impact such as from being dropped and/or absorbing the force of a luggage item colliding whilst in airline transit. In the inventors' experience, it is fairly common to see oversized baggage being thrown in piles at airport collection areas. To achieve this, a design should fit the sidewall of a variety of snowboard shapes/sizes whilst retaining the ability to grip and stay in place. Flexibility and strength are other important factors.

A snowboard can vary in appearance, but in most cases the sidewall dimensions vary only very little between the various manufacturers. The sidewall is the section which has been created when the top and bottom of the board is formed with a number of layers sandwiched together between them. The top layer usually covers a smaller surface area than the bottom layer and therefore the top layer is set back/offset from the bottom/base. This is critical to ensuring the steel base edge of the board is in contact with snow or ice at the point of a turn to ensure stability and grip. A snowboard is tapered—thicker in the middle and becoming thinner towards the nose and tail to ensure greater flexibility. The thickness of the sidewall is typically about 10 mm in the middle of the board and about 4 mm at the edges.

The majority of snowboards have the same round shape at the nose and tail, however some are designed differently to allow for deeper snow conditions or different style/type of ride. Common variations include a longer pointed nose, or a fish tail (similar to a surfboard) at the rear.

The design shown in the figures is able to hold position around the majority of snowboard shapes. It is in the form of an elongate extruded bead of industrial grade silicone with a Shore A hardness of 65, a grade selected for providing the most effective blend of strength, grip, and flexibility. We have determined that a hardness of 62 or 62.5 to 67.5 or 68 is acceptable, with 65 being the target for this product. The properties of silicone offer flexibility, varying degrees of strength, hardness, and impact absorption which work to ensure long term durability and addresses the fundamental objective of protecting the board. The Shore hardness range noted above combines the necessary hardness to meet the protective requirements with a degree of flexibility that enables the protector to meet the required shape and grip.

Figure 1:
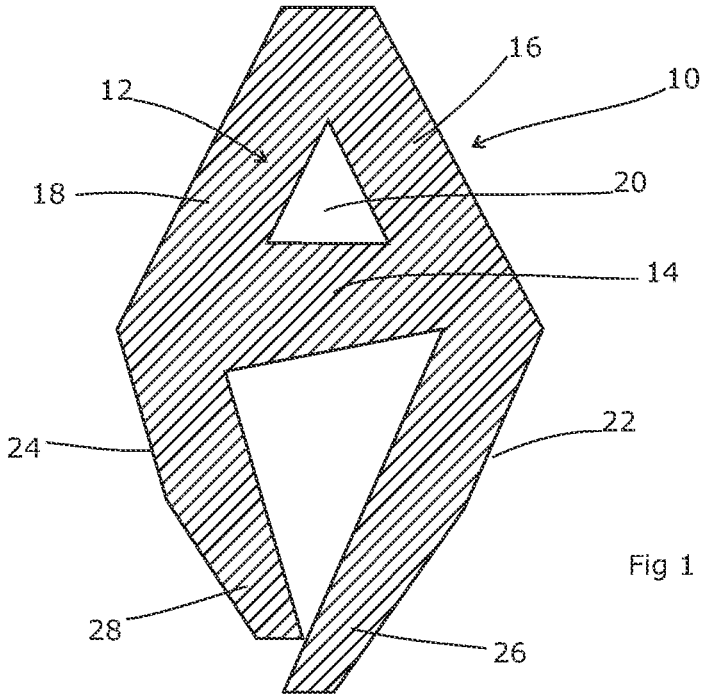
FIG. 1 shows a cross-section through an edge protector according to the present invention.

The processes for extruding Silicone are well characterised and will be familiar to those skilled in that art. Generally, it requires that the silicone is forced through a custom die which has a unique shape through which the silicone is forced. The shape of the die can be cut using a CNC machine. FIG. 1 shows the cross-sectional shape 10 created by the die according to the present invention. It consists of a generally triangular section 12 made up of a central base section 14 from which extend the other two sides 16, 18 of the triangle to form a generally equilateral shape. The triangle is made up of 4 mm (minimum) thick walls (except as noted below) and in this design has a hollow centre 20 in the shape of a similar triangle with a minimum of 4 mm long sides. This hollow centre saves weight and material, and also allows the triangular section to deform more easily under load; along with the wall thickness, this allows the impact properties of the protector to be tailored to provide an ideal balance between strength and flexibility. The triangular shape also spreads the impact force over most of the central section 14 thus dissipating the force.

Two legs 22, 24 extend from the other side of the central section 14, directed in the opposite direction to the triangular impact-absorbing section 12 in order to allow the protector 30 to be attached to the base and top surface covering the sidewall and steel edge of a snowboard. The legs are in the form of strips of 4 mm thick silicone, tapering in their outer halves 26, 28 down to approximately 2.3 mm. In the relaxed state shown in FIG. 1, the legs are angled together and almost meet at their tips. As a result of being angled together, they must be flexed apart in order to insert an edge between them; this allows the legs to grip the edge and retain the protector in place. One leg 22 is made slightly longer than the other leg 24 in order to make the process of insertion, application easier; the edge of the board can be pressed against the end of the longer leg 22 in order to open that leg and allow the legs to separate 22, 24.

The central section 14 has a non-uniform thickness, becoming approximately 50% thicker toward the base of the shorter leg 24 to act as an 'anti rocking' structure that prevents lateral movement when the protector is fitted. Thus, at the base of the longer leg 22 the central section 14 is (minimum) 4 mm thick, which increases steadily toward the base of the shorter leg 24 to a thickness of approximately 6 mm.

Figure 2:
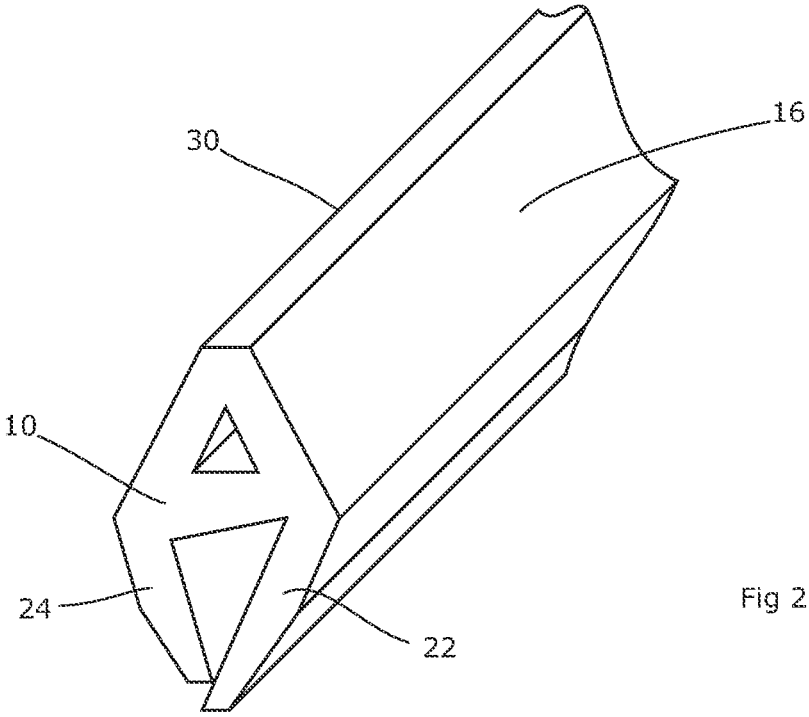
FIG. 2 shows a view of a length of edge protector according to the present invention.
Figure 3:
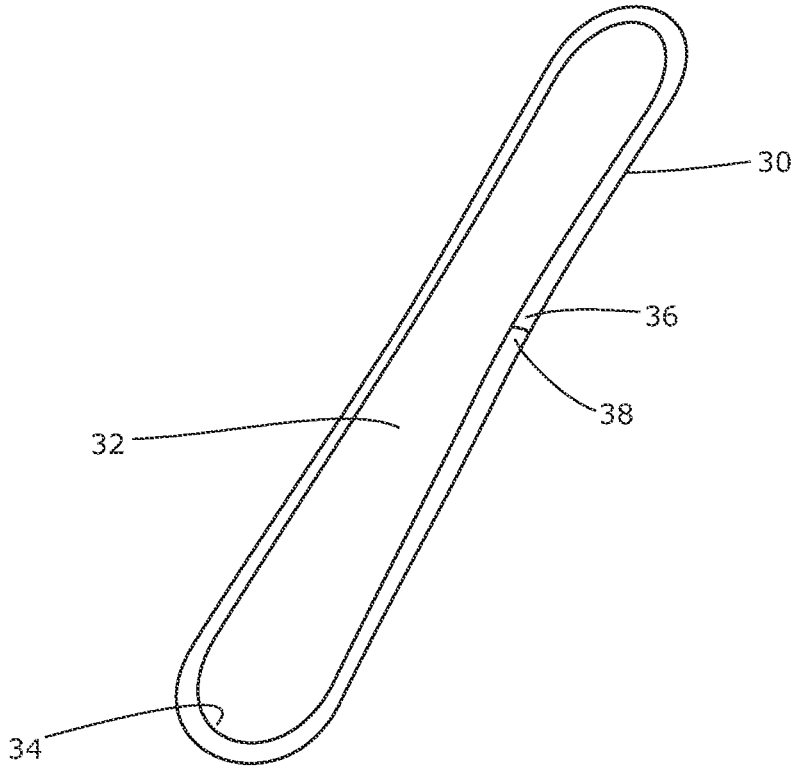
FIG. 3 shows a snowboard fitted with the edge protector of the present invention.

FIG. 2 shows a short length of the protector 30 strip in the form of an elongate bead with a substantially uniform cross-section 10 corresponding to that shown in FIG. 1. The product is made as one complete unit by extrusion, as noted above. As a result, it does not have parts or features which require maintenance. FIG. 3 shows the protector 30 applied to a snowboard 32, extending in a long loop around the edge 34 of the snowboard 32. The protector 30 starts at one end 36 which is ideally located along a long edge of the snowboard 32 where it is approximately straight or concave and the protector is unlikely to become detached. It extends around the length of the edge 34 to its other end 38 which can but up or end close to the start 36. As the perimeter lengths of snowboards vary, the protector can be provided in a slightly oversize form for trimming by the end user as required, or it can be provided in a standard size allowing for a gap between the ends which (in practice) will not adversely affect the protection offered.

Figure 4:
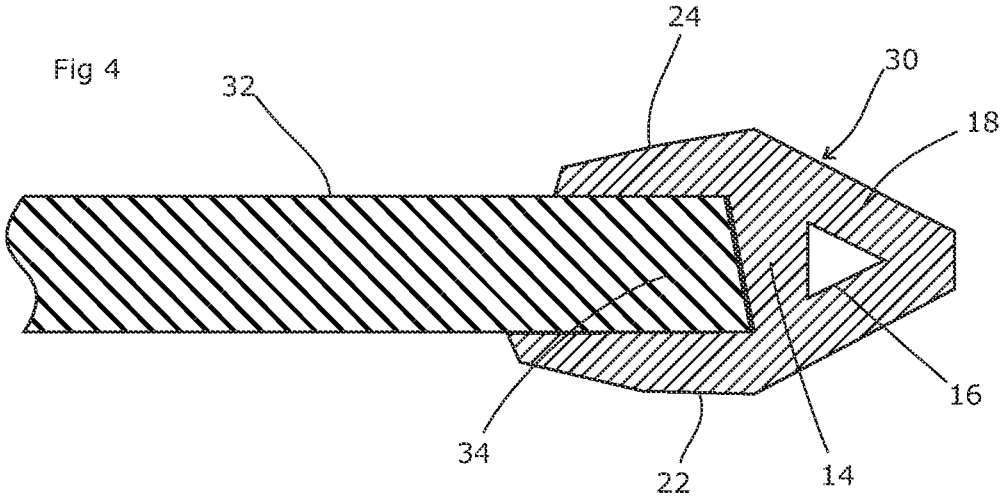
FIG. 4 shows a section through the edge of a snowboard fitted with the edge protector of the present invention.

FIG. 4 shows a section through the edge 34 of a snowboard 32 to which the protector 30 has been fitted. The legs 22, 24 are spread apart from their relaxed inwardly-angled position shown in FIG. 1 and grip the faces of the board 32 to provide the necessary friction to retain the protector 30 in place on the edge 34 of the board 32. The triangular section 12 extends away from the edge 34 and is thus located to accept and dissipate any incoming impacts.

Prototypes (of varying hardness) were tested using metal hammers to investigate the resilience of each prototype to the board's edge when subjected to force. The two factors that were most relevant were the point at which the silicone split against the steel rim of the board, and the resilience of the protector to the force of the hammer. We found the breaking point of the silicone at Shore A 65 was not easily reached, requiring a very strong force to eventually split the product against the board's edge. We also found that if the surface or inner seam of the protector splits slightly due to an impact, then that is still acceptable as the integrity of the board is still protected by the remainder of the triangular section.

Silicone offers a number of benefits in practice, including a resilience risk of general damage (not just in transit), stable properties over a wide range of temperatures, resistance to fungal or moisture damage, ease of application even with repeated usage, a pleasant aesthetic image and feel, and the ability to retain its properties over a long time without the need for regular maintenance.

It will of course be understood that many variations may be made to the above-described embodiment without departing from the scope of the present invention.

What is claimed is:

1. An edge protector for a sports board in the form of a bead of a resilient material having a cross-section comprising a central portion and, extending therefrom in one direction is a tapering impact-absorbing section and extending from the central portion in an opposing direction is a pair of convergent leg sections, the central portion and pair of convergent legs provided for engaging an edge of a sports board therein, wherein the central portion and the impact-absorbing section together form a hollow triangular cross-section and wherein the central portion has a non-uniform thickness, the central portion having an increasing thickness between bases of each leg section in the pair of convergent leg sections.

2. The edge protector according to claim 1 in which the hollow triangular section has a wall thickness of at least 4 mm.

3. The edge protector according to claim 1 in which the central portion forms one side of the triangle and the impact-absorbing section is provided by the remaining two sides of the triangle.

4. The edge protector according to claim 1 in which one leg of the pair extends beyond the other leg, providing a shorter leg section and a longer leg section in the pair of convergent leg sections.

5. The edge protector according to claim 1 in which the leg sections have a cross-sectional thickness of between 2 mm and 4.5 mm.

6. The edge protector according to claim 1 in which the legs are narrower at their tip than at their base.

7. The edge protector according to claim 1 in which the bead is formed by extrusion.

8. The edge protector according to claim 1 in which the resilient material is silicone.

9. The edge protector according to claim 8 in which the silicone has a Shore A hardness of between 62 and 68.

10. The edge protector according to claim 1 in which the cross-section of the bead is substantially constant along its length.

11. The edge protector according to claim 1 in which the sports board is one of a snowboard, a ski, a surfboard, a body board or a skateboard.

12. The edge protector according to claim 1 and wherein the edge protector is removably fitted to an edge of a sports board.

13. The edge protector according to claim 4 wherein the central portion becomes thicker toward the base of a shorter leg of the of pair of convergent legs.

14. The edge protector according to claim 4 wherein at a base of the longer leg section the central section is at least 4 mm thick, and the thickness of the central portion increases toward a base of the shorter leg section to a thickness of at least approximately 6 mm.

* * * * *